US010209033B1

(12) United States Patent
Moore et al.

(10) Patent No.: US 10,209,033 B1
(45) Date of Patent: Feb. 19, 2019

(54) LIGHT SIGHTING AND TRAINING DEVICE

(71) Applicants: Larry E. Moore, Cottonwood, AZ (US); Aaron Moore, Cottonwood, AZ (US)

(72) Inventors: Larry E. Moore, Cottonwood, AZ (US); Aaron Moore, Cottonwood, AZ (US)

( * ) Notice: Subject to any disclaimer, the term of this patent is extended or adjusted under 35 U.S.C. 154(b) by 0 days.

(21) Appl. No.: 15/884,122

(22) Filed: Jan. 30, 2018

(51) Int. Cl.

| | |
|---|---|
| ***F41A 33/00*** | (2006.01) |
| ***F41G 1/35*** | (2006.01) |
| ***F41A 33/02*** | (2006.01) |
| ***F41C 23/10*** | (2006.01) |

(52) U.S. Cl.
CPC ..... *F41G 1/35* (2013.01); *F41A 33/02* (2013.01); *F41C 23/10* (2013.01)

(58) Field of Classification Search
CPC ..... F41G 3/26; F41G 3/2616; F41G 3/2622; F41G 3/2655; F41A 33/00; F41A 33/02
USPC ..... 42/114; 434/19, 16
See application file for complete search history.

(56) References Cited

U.S. PATENT DOCUMENTS

| | | | |
|---|---|---|---|
| 1,490,272 | A | 4/1924 | Hickam |
| 1,898,566 | A | 2/1933 | Albert |
| 2,268,056 | A | 12/1941 | Nelson et al. |
| 2,308,627 | A | 1/1943 | Rickenbacher |
| 2,357,951 | A | 9/1944 | Hale |
| 2,430,469 | A | 11/1947 | Karnes |
| 2,597,565 | A | 5/1952 | Chandler et al. |
| 2,701,930 | A | 2/1955 | Dolan |
| 2,773,309 | A | 12/1956 | Elliot |
| 2,780,882 | A | 2/1957 | Temple |
| 2,826,848 | A | 3/1958 | Davies |
| 2,844,710 | A | 7/1958 | Rudolf |
| 2,894,117 | A | 7/1959 | Koskey |
| 2,904,888 | A | 9/1959 | Niesp |
| 2,926,916 | A | 3/1960 | Pearson |
| 3,104,478 | A | 9/1963 | Strauss |
| 3,112,567 | A | 12/1963 | Flanagan |
| 3,192,915 | A | 7/1965 | Norris et al. |
| 3,284,905 | A | 11/1966 | Simmons |
| 3,510,965 | A | 5/1970 | Rhea |
| 3,526,972 | A | 9/1970 | Sumpf |
| 3,573,868 | A | 4/1971 | Giannetti |

(Continued)

FOREIGN PATENT DOCUMENTS

| | | |
|---|---|---|
| BE | 1009564 | 5/1997 |
| EP | 1046877 | 10/2000 |
| FR | 862247 | 3/1941 |

OTHER PUBLICATIONS

USPTO; Requirement for Restriction dated Jun. 11, 2018 in U.S. Appl. No. 15/181,279.

(Continued)

*Primary Examiner* — J. Woodrow Eldred
(74) *Attorney, Agent, or Firm* — Snell & Wilmer L.L.P.

(57) ABSTRACT

A sighting/training device configured to be mounted to a pistol handle of a gun incorporates a light source, a power source, and a control. The device has at least two operating modes and a switch to select one of the modes. In a first operating mode the light source emits light when a button grip is pressed by a user, and does not emit light when the button grip is not depressed. In a second mode the light source emits light when a sound, such as the sound of a gun firing pin, is detected.

25 Claims, 9 Drawing Sheets

(56) References Cited

U.S. PATENT DOCUMENTS 3,618,673 A 11/1971 Gossett
3,633,285 A 1/1972 Sensney
3,641,676 A 2/1972 Knutsen et al.
3,645,635 A 2/1972 Steck
3,748,751 A 7/1973 Breglia
3,801,205 A 4/1974 Eggenschwyler
3,813,795 A 6/1974 Marshall
3,914,873 A 10/1975 Elliot, Jr. et al.
3,948,522 A 4/1976 Fixler
3,992,783 A 11/1976 Dunlap et al.
3,995,376 A * 12/1976 Kimble ..... F41A 33/02 434/22
4,026,054 A 5/1977 Snyder
4,048,489 A 9/1977 Giannetti
4,063,368 A 12/1977 McFarland
4,079,534 A 3/1978 Snyder
4,102,059 A 7/1978 Kimble et al.
4,144,505 A 3/1979 Angelbeck et al.
4,146,329 A 3/1979 King et al.
4,148,245 A 4/1979 Steffanus et al.
4,156,981 A 6/1979 Lusk
4,168,588 A 9/1979 Snyder
4,220,983 A 9/1980 Schroeder
4,222,564 A 9/1980 Allen
4,229,103 A 10/1980 Hipp
4,232,867 A 11/1980 Tate
4,233,770 A 11/1980 de Filippis et al.
4,234,911 A 11/1980 Faith
4,295,289 A 10/1981 Snyder
4,305,091 A 12/1981 Cooper
4,346,530 A 8/1982 Stewart
4,348,828 A 9/1982 Snyder
4,352,665 A 10/1982 Kimble et al.
4,452,458 A 6/1984 Timander
4,481,561 A 11/1984 Lanning
4,487,583 A 12/1984 Brucker
4,488,369 A 12/1984 Van Note
4,541,191 A 9/1985 Morris et al.
4,567,810 A 2/1986 Preston
4,662,845 A 5/1987 Gallaher
4,713,889 A 12/1987 Santiago
4,763,431 A 8/1988 Allan et al.
4,825,258 A 4/1989 Whitson
4,830,617 A 5/1989 Hancox et al.
4,860,775 A 8/1989 Reeves
4,876,816 A 10/1989 Triplett
4,878,307 A 11/1989 Singletary
4,891,476 A 1/1990 Nation et al.
4,934,086 A 6/1990 Houde-Walter
4,939,320 A 7/1990 Graulty
4,939,863 A 7/1990 Alexander et al.
4,945,667 A 8/1990 Rogalski et al.
4,953,316 A 9/1990 Litton et al.
4,967,642 A 11/1990 Mihaita
5,001,836 A 3/1991 Cameron et al.
5,004,423 A 4/1991 Bertrams
5,033,219 A 7/1991 Johnson et al.
5,048,211 A 9/1991 Hepp
5,048,215 A 9/1991 Davis
5,052,138 A 10/1991 Crain
5,090,805 A 2/1992 Stawarz
5,092,071 A 3/1992 Moore
5,119,576 A 6/1992 Erning
5,177,309 A 1/1993 Willoughby et al.
5,178,265 A 1/1993 Sepke
5,179,124 A 1/1993 Schoenwald et al.
5,179,235 A 1/1993 Toole
5,194,007 A 3/1993 Marshall
5,197,796 A 3/1993 Moore
5,208,826 A 5/1993 Kelly
5,228,427 A 7/1993 Gardner
5,237,773 A 8/1993 Claridge
5,241,146 A 8/1993 Priesemuth
5,272,514 A 12/1993 Dor
5,299,375 A 4/1994 Thummel et al.
5,343,376 A 8/1994 Huang
5,353,208 A 10/1994 Moore
5,355,608 A 10/1994 Teetzel
5,355,609 A 10/1994 Schenke
5,365,669 A 11/1994 Rustick et al.
5,367,779 A 11/1994 Lee
5,373,644 A 12/1994 De Paoli
5,375,362 A 12/1994 McGarry et al.
5,388,335 A 2/1995 Jung
5,392,550 A 2/1995 Moore et al.
5,400,540 A 3/1995 Solinsky et al.
5,419,072 A 5/1995 Moore et al.
5,432,598 A 7/1995 Szatkowski
5,435,091 A 7/1995 Toole et al.
5,446,535 A 8/1995 Williams
5,448,834 A 9/1995 Huang
5,454,168 A 10/1995 Langner
5,455,397 A 10/1995 Havenhill et al.
5,467,552 A 11/1995 Cupp et al.
5,481,819 A 1/1996 Teetzel
5,488,795 A 2/1996 Sweat
D368,121 S 3/1996 Lam
5,499,455 A 3/1996 Palmer
5,509,226 A 4/1996 Houde-Walter
5,515,636 A 5/1996 McGarry et al.
5,531,040 A 7/1996 Moore
5,555,662 A 9/1996 Teetzel
5,557,872 A 9/1996 Langner
5,566,459 A 10/1996 Breda
5,581,898 A 12/1996 Thummel
5,584,137 A 12/1996 Teetzel
5,590,486 A 1/1997 Moore
5,598,958 A 2/1997 Ryan, III et al.
5,605,461 A 2/1997 Seeton
5,618,099 A 4/1997 Brubacher
5,621,999 A 4/1997 Moore
5,622,000 A 4/1997 Marlowe
5,654,594 A 8/1997 Bjornsen, III
5,669,174 A 9/1997 Teetzel
5,671,561 A 9/1997 Johnson et al.
5,685,106 A 11/1997 Shoham
5,685,636 A 11/1997 German
5,694,202 A 12/1997 Mladjan et al.
5,694,713 A 12/1997 Paldino
5,704,153 A 1/1998 Kaminski et al.
5,706,600 A 1/1998 Toole et al.
5,716,216 A 2/1998 O'Loughlin
5,735,070 A 4/1998 Vasquez et al.
5,787,631 A 8/1998 Kendall
5,788,500 A 8/1998 Gerber
5,822,905 A 10/1998 Teetzel
5,842,300 A 12/1998 Cheshelski et al.
5,842,942 A 12/1998 Doht et al.
5,847,345 A 12/1998 Harrison
5,867,930 A 2/1999 Kaminski et al.
5,881,707 A 3/1999 Gardner
5,892,221 A 4/1999 Lev
5,896,691 A 4/1999 Kaminski et al.
5,905,238 A 5/1999 Hung
5,909,951 A 6/1999 Johnsen et al.
5,922,030 A 7/1999 Shank et al.
5,967,133 A 10/1999 Gardner
5,983,774 A 11/1999 Mihaita
6,003,504 A 12/1999 Rice et al.
6,023,875 A 2/2000 Fell et al.
6,035,843 A 3/2000 Smith et al.
6,146,141 A 11/2000 Schumann
6,151,788 A 11/2000 Cox et al.
6,219,952 B1 4/2001 Mossberg et al.
6,230,431 B1 5/2001 Bear
6,237,271 B1 5/2001 Kaminski
6,282,829 B1 9/2001 Mossberg et al.
6,289,624 B1 9/2001 Hughes et al.
6,293,869 B1 9/2001 Kwan
6,295,753 B1 10/2001 Thummel
6,301,046 B1 10/2001 Tai et al.
6,318,228 B1 11/2001 Thompson
6,327,806 B1 12/2001 Paige
6,363,648 B1 4/2002 Kranich et al.

(56) References Cited

U.S. PATENT DOCUMENTS

| | | | |
|---|---|---|---|
| 6,366,349 | B1 | 4/2002 | Houde-Walter |
| 6,371,004 | B1 | 4/2002 | Peterson |
| 6,378,237 | B1 | 4/2002 | Matthews et al. |
| 6,385,893 | B1 | 5/2002 | Cheng |
| 6,389,729 | B2 | 5/2002 | Rauch et al. |
| 6,389,730 | B1 | 5/2002 | Millard |
| 6,397,509 | B1 | 6/2002 | Langner |
| 6,421,947 | B1 | 7/2002 | Fuller |
| 6,430,861 | B1 | 8/2002 | Ayers et al. |
| 6,434,874 | B1 | 8/2002 | Hines |
| 6,442,880 | B1 | 9/2002 | Allan |
| 6,345,464 | B1 | 12/2002 | Kim et al. |
| 6,487,807 | B1 | 12/2002 | Kopman et al. |
| 6,499,247 | B1 | 12/2002 | Peterson |
| 6,526,688 | B1 | 3/2003 | Danielson et al. |
| 6,568,118 | B1 | 5/2003 | Teetzel |
| 6,571,503 | B2 | 6/2003 | Thorpe |
| 6,572,375 | B2 | 6/2003 | Shechter et al. |
| 6,575,753 | B2 | 6/2003 | Rosa et al. |
| 6,578,311 | B2 | 6/2003 | Danielson et al. |
| 6,579,098 | B2 | 6/2003 | Shechter et al. |
| 6,591,536 | B2 | 7/2003 | Houde-Walter et al. |
| 6,606,797 | B1 | 8/2003 | Gandy |
| 6,614,510 | B1 | 9/2003 | Rogers et al. |
| 6,616,452 | B2 | 9/2003 | Clark et al. |
| 6,622,414 | B1 | 9/2003 | Oliver et al. |
| 6,631,580 | B2 | 10/2003 | Iafrate |
| 6,631,668 | B1 | 10/2003 | Wilson et al. |
| 6,650,669 | B1 | 11/2003 | Adkins |
| 6,671,991 | B1 | 1/2004 | Danielson |
| 6,682,350 | B2 | 1/2004 | Kehl |
| D487,791 | S | 3/2004 | Freed |
| 6,742,299 | B2 | 6/2004 | Strand |
| 6,749,075 | B2 | 6/2004 | Bourque |
| 6,782,789 | B2 | 8/2004 | McNulty |
| 6,804,907 | B1 | 10/2004 | Slobodkin |
| 6,843,478 | B1 | 1/2005 | Hoepelman |
| 6,854,205 | B2 | 2/2005 | Wikle et al. |
| 6,860,053 | B2 | 3/2005 | Christiansen |
| 6,931,775 | B2 | 8/2005 | Burnett |
| 6,935,864 | B2 | 8/2005 | Shechter et al. |
| 6,945,782 | B2 | 9/2005 | Isoz |
| 6,966,775 | B1 | 11/2005 | Kendir et al. |
| 7,032,342 | B2 | 4/2006 | Pikielny |
| 7,049,575 | B2 | 5/2006 | Hotelling |
| 7,111,424 | B1 | 9/2006 | Moody et al. |
| 7,117,624 | B2 | 10/2006 | Kim |
| 7,121,034 | B2 | 10/2006 | Keng |
| 7,134,234 | B1 | 11/2006 | Makarounis |
| 7,191,557 | B2 | 3/2007 | Gablowski et al. |
| D542,446 | S | 5/2007 | DiCarlo et al. |
| 7,218,501 | B2 | 5/2007 | Keely |
| 7,237,352 | B2 | 7/2007 | Keely et al. |
| 7,243,454 | B1 | 7/2007 | Cahill |
| 7,260,910 | B2 | 8/2007 | Danielson |
| 7,264,369 | B1 | 9/2007 | Howe |
| 7,303,306 | B2 | 12/2007 | Ross et al. |
| 7,305,790 | B2 | 12/2007 | Kay |
| 7,325,352 | B2 | 2/2008 | Matthews et al. |
| 7,329,127 | B2 | 2/2008 | Kendir et al. |
| 7,331,137 | B2 | 2/2008 | Hsu |
| D567,894 | S | 4/2008 | Sterling et al. |
| 7,360,333 | B2 | 4/2008 | Kim |
| D570,948 | S | 6/2008 | Cerovic et al. |
| 7,387,052 | B2 | 6/2008 | Chang |
| RE40,429 | E | 7/2008 | Oliver et al. |
| 7,409,770 | B2 | 8/2008 | Jones |
| D578,599 | S | 10/2008 | Cheng |
| 7,438,430 | B2 | 10/2008 | Kim |
| 7,441,364 | B2 | 10/2008 | Rogers et al. |
| 7,453,918 | B2 | 11/2008 | Laughman et al. |
| 7,454,858 | B2 | 11/2008 | Griffin |
| 7,464,495 | B2 | 12/2008 | Cahill |
| 7,472,830 | B2 | 1/2009 | Danielson |
| D586,874 | S | 2/2009 | Moody et al. |
| 7,490,429 | B2 | 2/2009 | Moody et al. |
| 7,505,119 | B2 | 3/2009 | Rogers et al. |
| 7,578,089 | B1 | 8/2009 | Griffin |
| 7,584,569 | B2 | 9/2009 | Kallio |
| 7,591,098 | B2 | 9/2009 | Matthews et al. |
| D602,109 | S | 10/2009 | Cerovic et al. |
| 7,603,997 | B2 | 10/2009 | Hensel et al. |
| D603,478 | S | 11/2009 | Hughes |
| 7,624,528 | B1 | 12/2009 | Bell et al. |
| 7,627,976 | B1 | 12/2009 | Olson |
| 7,644,530 | B2 | 1/2010 | Scherpf |
| 7,652,216 | B2 | 1/2010 | Sharrah et al. |
| D612,756 | S | 3/2010 | D'Amelio et al. |
| D612,757 | S | 3/2010 | D'Amelio et al. |
| 7,674,003 | B2 | 3/2010 | Sharrah et al. |
| 7,676,975 | B2 | 3/2010 | Phillips et al. |
| 7,685,756 | B2 | 3/2010 | Moody et al. |
| 7,698,847 | B2 | 4/2010 | Griffin |
| 7,703,719 | B1 | 4/2010 | Bell et al. |
| 7,712,241 | B2 | 5/2010 | Teetzel et al. |
| D616,957 | S | 6/2010 | Rievley et al. |
| 7,726,059 | B2 | 6/2010 | Pikielny |
| 7,726,061 | B1 | 6/2010 | Thummel |
| 7,730,820 | B2 | 6/2010 | Vice et al. |
| 7,743,546 | B2 | 6/2010 | Keng |
| 7,743,547 | B2 | 6/2010 | Houde-Walter |
| 7,753,549 | B2 | 7/2010 | Solinsky et al. |
| 7,771,077 | B2 | 8/2010 | Miller |
| 7,797,843 | B1 | 9/2010 | Scott et al. |
| 7,805,876 | B1 | 10/2010 | Danielson et al. |
| 7,818,910 | B2 | 10/2010 | Young |
| 7,827,726 | B2 | 11/2010 | Stokes |
| 7,841,120 | B2 | 11/2010 | Teetzel et al. |
| 7,880,100 | B2 | 2/2011 | Sharrah et al. |
| 7,900,390 | B2 | 3/2011 | Moody et al. |
| 7,913,439 | B2 | 3/2011 | Whaley |
| D636,049 | S | 4/2011 | Hughes et al. |
| D636,837 | S | 4/2011 | Hughes et al. |
| 7,921,591 | B1 | 4/2011 | Adcock |
| 7,926,218 | B2 | 4/2011 | Matthews et al. |
| 7,997,023 | B2 | 8/2011 | Moore et al. |
| 8,001,715 | B2 | 8/2011 | Stokes |
| 8,006,427 | B2 | 8/2011 | Blevins et al. |
| 8,006,428 | B2 | 8/2011 | Moore et al. |
| 8,028,460 | B2 | 10/2011 | Williams |
| 8,028,461 | B2 | 10/2011 | NuDyke |
| 8,050,307 | B2 | 11/2011 | Day et al. |
| 8,056,277 | B2 | 11/2011 | Griffin |
| 8,093,992 | B2 | 1/2012 | Jancie et al. |
| 8,100,694 | B2 | 1/2012 | Portoghese |
| 8,104,220 | B2 | 1/2012 | Cobb |
| D653,798 | S | 2/2012 | Janice et al. |
| 8,109,024 | B2 | 2/2012 | Abst |
| 8,110,760 | B2 | 2/2012 | Sharrah et al. |
| 8,127,485 | B2 | 3/2012 | Moore |
| 8,132,352 | B2 | 3/2012 | Lippard |
| 8,132,354 | B1 | 3/2012 | Sellers et al. |
| 8,136,284 | B2 | 3/2012 | Moody et al. |
| 8,141,288 | B2 | 3/2012 | Dodd et al. |
| 8,146,282 | B2 | 4/2012 | Cabahug et al. |
| 8,147,304 | B2 | 4/2012 | Yamada |
| 8,151,504 | B1 | 4/2012 | Aiston |
| 8,151,505 | B2 | 4/2012 | Thompson |
| 8,166,694 | B2 | 5/2012 | Swan |
| 8,172,139 | B1 | 5/2012 | McDonald et al. |
| 8,182,109 | B2 | 5/2012 | Matthews et al. |
| D661,366 | S | 6/2012 | Zusman |
| 8,196,328 | B2 | 6/2012 | Simpkins |
| 8,215,047 | B2 | 7/2012 | Ash et al. |
| 8,225,542 | B2 | 7/2012 | Houde-Walter |
| 8,225,543 | B2 | 7/2012 | Moody et al. |
| 8,245,428 | B2 | 8/2012 | Griffin |
| 8,245,434 | B2 | 8/2012 | Hogg et al. |
| 8,256,154 | B2 | 9/2012 | Danielson et al. |
| 8,258,416 | B2 | 9/2012 | Sharrah et al. |
| D669,552 | S | 10/2012 | Essig et al. |
| D669,553 | S | 10/2012 | Hughes et al. |
| D669,957 | S | 10/2012 | Hughes et al. |
| D669,958 | S | 10/2012 | Essig et al. |

(56) References Cited

U.S. PATENT DOCUMENTS

D669,959 S 10/2012 Johnston et al.
D670,785 S 11/2012 Fitzpatrick et al.
8,312,666 B2 11/2012 Moore et al.
D672,005 S 12/2012 Hedeen et al.
8,322,064 B2 12/2012 Cabahug et al.
8,335,413 B2 12/2012 Dromaretsky et al.
D674,861 S 1/2013 Johnston et al.
D674,862 S 1/2013 Johnston et al.
D675,281 S 1/2013 Speroni
8,341,868 B2 1/2013 Zusman
8,347,541 B1 1/2013 Thompson
8,356,543 B2 1/2013 Rosol et al.
8,356,818 B2 1/2013 Mraz
8,360,598 B2 1/2013 Sharrah et al.
D676,097 S 2/2013 Izumi
8,365,456 B1 2/2013 Shepard
D677,433 S 3/2013 Swan et al.
D678,976 S 3/2013 Pittman
8,387,294 B2 3/2013 Bolden
8,393,104 B1 3/2013 Moody et al.
8,393,105 B1 3/2013 Thummel
8,397,418 B2 3/2013 Cabahug et al.
8,402,683 B2 3/2013 Cabahug et al.
8,413,362 B2 4/2013 Houde-Walter
D682,977 S 5/2013 Thummel et al.
8,443,539 B2 5/2013 Cabahug et al.
8,444,291 B2 5/2013 Swan et al.
8,448,368 B2 5/2013 Cabahug et al.
8,458,944 B2 6/2013 Houde-Walter
8,464,451 B2 6/2013 McRae
8,467,430 B2 6/2013 Caffey et al.
8,468,734 B2 6/2013 Meller et al.
8,468,930 B1 6/2013 Bell
D687,120 S 7/2013 Hughes et al.
8,480,329 B2 7/2013 Fluhr et al.
8,484,880 B1 7/2013 Sellers et al.
8,484,882 B2 7/2013 Haley et al.
8,485,686 B2 7/2013 Swan et al.
8,510,981 B1 8/2013 Ganther et al.
8,516,731 B2 8/2013 Cabahug et al.
8,567,981 B2 10/2013 Finnegan et al.
8,584,587 B2 11/2013 Uhr
8,607,495 B2 12/2013 Moore et al.
D697,162 S 1/2014 Faifer
D697,163 S 1/2014 Bietsch
8,646,201 B2 2/2014 Hughes
8,661,725 B1 3/2014 Ganther et al.
8,662,694 B1 3/2014 Izumi et al.
8,734,156 B2 5/2014 Uhr
8,739,447 B2 6/2014 Merritt et al.
D709,585 S 7/2014 Klecker
D710,966 S 8/2014 Barfoot
8,807,779 B1 8/2014 Izumi et al.
8,813,411 B2 8/2014 Moore et al.
8,844,189 B2 9/2014 Moore et al.
D720,423 S 12/2014 Barfoot
8,915,009 B2 12/2014 Caulk
8,919,023 B2 12/2014 Merritt et al.
8,927,083 B2 1/2015 Pell
8,938,904 B1 1/2015 Sellers et al.
D722,125 S 2/2015 Zayatz
8,944,626 B2 2/2015 Matthews et al.
8,944,838 B2 2/2015 Mulfinger
8,991,093 B1 3/2015 Calvert
9,011,279 B2 4/2015 Johnson et al.
9,023,459 B2 5/2015 Hogue
9,146,077 B2 9/2015 Moore
9,182,194 B2 11/2015 Moore
9,188,407 B2 11/2015 Moore
9,243,865 B1 1/2016 Bruhns
9,272,402 B2 3/2016 Hu
9,297,614 B2 3/2016 Moore
9,453,702 B2 9/2016 Bruhns
9,644,826 B2 5/2017 Moore
9,658,031 B1 5/2017 Hedeen
9,772,163 B2 9/2017 Sharrah et al.
9,777,984 B1 10/2017 Bonine
9,791,240 B2 10/2017 Bruhns
D802,704 S 11/2017 Planck
9,810,411 B2 11/2017 Galli
9,829,280 B1 11/2017 Moore et al.
9,841,254 B2 12/2017 Moore
9,915,508 B2 3/2018 Moore et al.
9,982,963 B2 5/2018 Johnson
10,113,836 B2 10/2018 Moore et al.
2001/0042335 A1 11/2001 Strand
2002/0009694 A1 1/2002 Rosa
2002/0051953 A1 5/2002 Clark et al.
2002/0057719 A1 5/2002 Shechter
2002/0073561 A1 6/2002 Liao
2002/0104249 A1 8/2002 Lin
2002/0129536 A1 9/2002 Iafrate et al.
2002/0134000 A1 9/2002 Varshneya et al.
2002/0148153 A1 10/2002 Thorpe
2002/0194767 A1 12/2002 Houde Walter et al.
2003/0003424 A1 1/2003 Shechter et al.
2003/0022135 A1* 1/2003 Shechter ..... F41A 21/26 434/16
2003/0029072 A1 2/2003 Danielson
2003/0084601 A1 5/2003 Kunimoto
2003/0175661 A1 9/2003 Shechter et al.
2003/0180692 A1 9/2003 Skala et al.
2003/0196366 A1 10/2003 Beretta
2004/0003529 A1 1/2004 Danielson
2004/0010956 A1 1/2004 Bubits
2004/0014010 A1 1/2004 Swensen et al.
2004/0064994 A1 4/2004 Luke
2005/0044736 A1 3/2005 Liao
2005/0130739 A1 6/2005 Argentar
2005/0153262 A1 7/2005 Kendir
2005/0185403 A1 8/2005 Diehl
2005/0188588 A1 9/2005 Keng
2005/0241209 A1 11/2005 Staley
2005/0257415 A1 11/2005 Solinsky et al.
2005/0268519 A1 12/2005 Pikielny
2006/0162225 A1 7/2006 Danielson
2006/0191183 A1 8/2006 Griffin
2007/0039226 A1 2/2007 Stokes
2007/0041418 A1 2/2007 Laughman et al.
2007/0056203 A1 3/2007 Gering et al.
2007/0113460 A1 5/2007 Potterfield et al.
2007/0190495 A1 8/2007 Kendir et al.
2007/0258236 A1 11/2007 Miller
2007/0271832 A1 11/2007 Griffin
2008/0000133 A1 1/2008 Solinsky et al.
2008/0060248 A1 3/2008 Pine et al.
2008/0134562 A1 6/2008 Teetzel
2009/0013580 A1 1/2009 Houde-Walter
2009/0013581 A1 1/2009 LoRocco
2009/0053679 A1 2/2009 Jones
2009/0178325 A1 7/2009 Veilleux
2009/0183416 A1 7/2009 Danielson
2009/0293335 A1 12/2009 Danielson
2009/0293855 A1 12/2009 Danielson
2009/0323733 A1 12/2009 Charkas
2010/0058640 A1 3/2010 Moore et al.
2010/0162610 A1 7/2010 Moore et al.
2010/0175297 A1 7/2010 Speroni
2010/0227298 A1 9/2010 Charles
2010/0229448 A1 9/2010 Houde-Walter
2010/0263254 A1 10/2010 Glock
2010/0275496 A1 11/2010 Solinsky et al.
2011/0047850 A1 3/2011 Rievley et al.
2011/0061283 A1 3/2011 Cavallo
2011/0074303 A1 3/2011 Stokes
2011/0119868 A1 5/2011 LaLonde
2011/0154712 A1 6/2011 Moore
2011/0162249 A1 7/2011 Woodmansee et al.
2011/0162251 A1 7/2011 Houde-Walter
2011/0185619 A1 8/2011 Finnegan et al.
2011/0225867 A1 9/2011 Moore
2012/0005938 A1 1/2012 Sloan
2012/0047787 A1 3/2012 Curry
2012/0055061 A1 3/2012 Hartley et al.

(56) References Cited

U.S. PATENT DOCUMENTS

| | | | |
|---|---|---|---|
| 2012/0110886 | A1 | 5/2012 | Moore et al. |
| 2012/0124885 | A1 | 5/2012 | Caulk et al. |
| 2012/0129136 | A1 | 5/2012 | Dvorak |
| 2012/0144716 | A1 | 6/2012 | Cabahug et al. |
| 2012/0144718 | A1 | 6/2012 | Danielson |
| 2012/0180366 | A1 | 7/2012 | Jaroh et al. |
| 2012/0180367 | A1 | 7/2012 | Singh |
| 2012/0180370 | A1 | 7/2012 | McKinley |
| 2012/0224357 | A1 | 9/2012 | Moore |
| 2012/0224387 | A1 | 9/2012 | Moore |
| 2012/0268920 | A1 | 10/2012 | Matthews |
| 2013/0185978 | A1 | 7/2013 | Dodd et al. |
| 2013/0185982 | A1 | 7/2013 | Hilbourne et al. |
| 2013/0205635 | A1 | 8/2013 | Hines |
| 2013/0263492 | A1 | 10/2013 | Erdle |
| 2013/0318851 | A1 | 12/2013 | Diamond |
| 2014/0007485 | A1 | 1/2014 | Castejon |
| 2014/0109457 | A1 | 4/2014 | Speroni |
| 2014/0157645 | A1 | 6/2014 | Moore |
| 2014/0176463 | A1 | 6/2014 | Donahoe |
| 2014/0256481 | A1 | 9/2014 | Flint |
| 2014/0355258 | A1 | 12/2014 | Izumi et al. |
| 2015/0192391 | A1 | 7/2015 | Moore |
| 2015/0226508 | A1 | 8/2015 | Hughes |
| 2015/0233668 | A1 | 8/2015 | Moore |
| 2015/0283459 | A1 | 10/2015 | Condon |
| 2015/0308670 | A1 | 10/2015 | Moore |
| 2015/0345905 | A1 | 12/2015 | Hancosky |
| 2015/0348330 | A1 | 12/2015 | Balachandreswaran |
| 2016/0059136 | A1 | 3/2016 | Ferris |
| 2016/0084618 | A1 | 3/2016 | Hong |
| 2016/0091285 | A1 | 3/2016 | Mason |
| 2016/0161220 | A1 | 6/2016 | Moore |
| 2016/0169608 | A1 | 6/2016 | Schulz |
| 2016/0195366 | A1 | 7/2016 | Kowalczyk et al. |
| 2016/0209170 | A1 | 7/2016 | Mock et al. |
| 2016/0209174 | A1 | 7/2016 | Hartley et al. |
| 2016/0245617 | A1 | 8/2016 | Moore |
| 2016/0305748 | A1 | 10/2016 | Moore |
| 2016/0361626 | A1 | 12/2016 | Moore |
| 2017/0003103 | A1 | 1/2017 | Moore |
| 2017/0030677 | A1 | 2/2017 | Faifer |
| 2017/0082399 | A1 | 3/2017 | Moore |
| 2017/0153095 | A1 | 6/2017 | Moore |
| 2017/0160054 | A1 | 6/2017 | Moore |
| 2017/0205182 | A1 | 7/2017 | Hughes et al. |
| 2018/0023923 | A1 | 1/2018 | Uhr |
| 2018/0058804 | A1 | 3/2018 | Moore |
| 2018/0135944 | A1 | 5/2018 | Moore |
| 2018/0149443 | A1 | 5/2018 | Dottle |

OTHER PUBLICATIONS

USPTO; Advisory Action dated Jun. 14, 2018 in U.S. Appl. No. 15/253,543.
USPTO; Notice of Allowance dated Jun. 20, 2018 in U.S. Appl. No. 15/787,134.
USPTO; Non-Final Office Action dated Jun. 29, 2018 in U.S. Appl. No. 15/600,571.
USPTO; Non-Final Office Action dated Jul. 3, 2018 in U.S. Appl. No. 14/963,475.
USPTO; Notice of Allowance dated Jul. 18, 2018 in U.S. Appl. No. 15/075,769.
USPTO; Non-Final Office Action dated Jul. 20, 2018 in U.S. Appl. No. 15/253,543.
Google Search for crossbow laser, image search conducted on Nov. 29, 2017, 14 pages.
Google Search for crossbow laser, image search conducted on Nov. 29, 2017, 2 pages.
CrossbowNation-Community-Gear Review, Crossbow Laser Boresighter Bolt Video Review, 1 page, printed on Nov. 29, 2017, dated Apr. 18, 2010.
CrossbowNation, Gear Review, Crossbow Laser Boresighter Bolt Video Review, 6 images taken therefrom, 6 pages, printed on Nov. 29, 2017, dated Apr. 18, 2010.
Ducet, "Arsenal Strike One Review," http://dennyducet.blogspot.com/2015/06/the-arsenal-strike-one-innovative.html, (Jun. 18, 2015).
EPO; Office Action dated Oct. 5, 2011 in Serial No. 09169459.
EPO; Office Action dated Oct. 5, 2011 in Serial No. 09169469.
EPO; Office Action dated Dec. 20, 2011 in Application No. 09169476.
EPO; Office Action dated Sep. 3, 2012 in Application No. 09169469.
EPO; Office Action dated Sep. 3, 2012 in Application No. 09169476.
EPO; Office Action dated Sep. 3, 2012 in Application No. 09169459.
EPO; Search Opinion and Report dated Aug. 6, 2010 in Serial No. 09169459.
EPO; Search Opinion and Report dated Aug. 6, 2010 in Serial No. 09169469.
EPO; Search Opinion and Report dated Aug. 23, 2010 in Serial No. 09169476.
EPO; Search Report and Opinion dated Aug. 6, 2012 in Serial No. 11151504.
USPTO; Advisory Action dated Aug. 22, 2011 in U.S. Appl. No. 12/249,781.
USPTO; Advisory Action dated Jul. 13, 2012 in U.S. Appl. No. 12/249,781.
USPTO; Final Office Action dated Feb. 24, 2010 in U.S. Appl. No. 11/317,647.
USPTO; Final Office Action dated Mar. 6, 2012 in U.S. Appl. No. 12/610,213.
USPTO; Final Office Action dated May 2, 2012 in U.S. Appl. No. 12/249,781.
USPTO; Final Office Action dated Jun. 19, 2009 in U.S. Appl. No. 11/317,647.
USPTO; Final Office Action dated May 18, 2011 in U.S. Appl. No. 12/249,781.
USPTO; Final Office Action dated Aug. 7, 2012 in U.S. Appl. No. 12/249,781.
USPTO; Notice of Allowance dated Feb. 2, 2011 in U.S. Appl. No. 12/249,794.
USPTO; Notice of Allowance dated Feb. 26, 2002 in U.S. Appl. No. 09/624,124.
USPTO; Notice of Allowance dated Mar. 3, 2011 in U.S. Appl. No. 12/249,785.
USPTO; Notice of Allowance dated May 13, 2011 in U.S. Appl. No. 12/249,785.
USPTO; Notice of Allowance dated May 17, 2011 in U.S. Appl. No. 13/077,861.
USPTO; Notice of Allowance dated Jul. 8, 2011 in U.S. Appl. No. 12/249,794.
USPTO; Notice of Allowance dated Sep. 1, 2011 in U.S. Appl. No. 13/077,861.
USPTO; Notice of Allowance dated Nov. 1, 2011 in U.S. Appl. No. 13/077,875.
USPTO; Notice of Allowance dated Nov. 18, 2011 in U.S. Appl. No. 13/077,861.
USPTO; Notice of Allowance dated Jul. 25, 2012 in U.S. Appl. No. 12/610,213.
USPTO; Notice of Allowance dated Aug. 16, 2012 in U.S. Appl. No. 13/346,621.
USPTO; Office Action dated Jan. 26, 2012 in U.S. Appl. No. 12/249,781.
USPTO; Office Action dated Sep. 28, 2009 in U.S. Appl. No. 11/317,647.
USPTO; Office Action dated Oct. 6, 2010 in U.S. Appl. No. 12/249,794.
USPTO; Office Action dated Oct. 18, 2011 in U.S. Appl. No. 12/610,213.
USPTO; Office Action dated Nov. 8, 2010 in U.S. Appl. No. 12/249,781.
USPTO; Office Action dated Dec. 26, 2008 in U.S. Appl. No. 11/317,647.
USPTO; Office Action dated Jun. 11, 2001 in U.S. Appl. No. 09/624,124.
USPTO; Office Action dated Jun. 22, 2011 in U.S. Appl. No. 13/077,875.

(56) References Cited

OTHER PUBLICATIONS

USPTO; Office Action dated Nov. 15, 2012 in U.S. Appl. No. 13/412,385.
USPTO; Office Action dated Feb. 1, 2013 in U.S. Appl. No. 12/249,781.
USPTO; Office Action dated Feb. 20, 2013 in U.S. Appl. No. 13/670,278.
USPTO; Office Action dated Mar. 26, 2013 in U.S. Appl. No. 13/353,241.
USPTO; Final Office Action dated Sep. 24, 2013 in U.S. Appl. No. 13/353,241.
USPTO; Office Action dated Jan. 31, 2014 in U.S. Appl. No. 13/353,241.
USPTO; Final Office Action dated Sep. 10, 2014 in U.S. Appl. No. 13/353,241.
USPTO; Office Action dated Oct. 23, 2012 in U.S. Appl. No. 13/010,649.
USPTO; Final Office Action dated Apr. 11, 2013 in U.S. Appl. No. 13/010,649.
USPTO; Final Office Action dated May 16, 2013 in U.S. Appl. No. 13/412,385.
USPTO; Office Action dated Jun. 17, 2013 in U.S. Appl. No. 13/353,301.
USPTO; Notice of Allowance dated Jan. 18, 2012 in U.S. Appl. No. 13/353,301.
USPTO; Office Action dated Jun. 19, 2013 in U.S. Appl. No. 13/353,165.
USPTO; Final Office Action dated Jul. 29, 2014 in U.S. Appl. No. 13/353,165.
USPTO; Office Action dated Nov. 20, 2014 in U.S. Appl. No. 13/353,165.
USPTO; Notice of Allowance dated Jun. 5, 2015 in U.S. Appl. No. 13/353,165.
USPTO; Notice of Allowance dated Jul. 24, 2015 in U.S. Appl. No. 13/353,165.
USPTO; Final Office Action dated Jun. 24, 2013 in U.S. Appl. No. 13/670,278.
USPTO; Office Action dated Dec. 11, 2013 in U.S. Appl. No. 13/670,278.
USPTO; Notice of Allowance dated Apr. 25, 2014 in U.S. Appl. No. 13/670,278.
USPTO; Notice of Allowance dated Jul. 15, 2013 in U.S. Appl. No. 13/412,385.
USPTO; Office Action dated Nov. 4, 2013 in U.S. Appl. No. 13/412,385.
USPTO; Final Office Action dated Mar. 27, 2014 in U.S. Appl. No. 13/412,385.
USPTO; Office Action dated Sep. 30, 2014 in U.S. Appl. No. 13/412,385.
USPTO; Notice of Allowance dated Aug. 6, 2013 in U.S. Appl. No. 13/010,649.
USPTO; Notice of Allowance dated Jul. 22, 2013 in U.S. Appl. No. 12/249,781.
USPTO; Decision on Appeal dated Aug. 20, 2013 in U.S. Appl. No. 11/317,647.
USPTO; Office Action dated Jan. 27, 2014 in U.S. Appl. No. 13/707,312.
USPTO; Notice of Allowance dated Jun. 11, 2014 in U.S. Appl. No. 13/707,312.
USPTO; Notice of Allowance dated Jul. 7, 2015 in U.S. Appl. No. 14/182,140.
USPTO; Office Action dated Aug. 19, 2014 in U.S. Appl. No. 14/316,688.
USPTO; Final Office Action dated Jan. 27, 2015 in U.S. Appl. No. 14/316,688.
USPTO; Notice of Allowance dated Jun. 24, 2015 in U.S. Appl. No. 14/316,688.
USPTO; Office Action dated Mar. 3, 2015 in U.S. Appl. No. 14/278,315.
USPTO; Notice of Allowance dated Jun. 24, 2015 in U.S. Appl. No. 14/278,315.
USPTO; Office Action dated Jul. 2, 2015 in U.S. Appl. No. 14/459,274.
USPTO; Notice of Allowance dated Nov. 24, 2015 in U.S. Appl. No. 14/459,274.
USPTO; Notice of Allowance dated Nov. 15, 2016 in U.S. Appl. No. 14/630,467.
USPTO; Non-Final Office Action dated Aug. 30, 2016 in U.S. Appl. No. 14/955,440.
USPTO; Non-Final Office Action dated Oct. 6, 2016 in U.S. Appl. No. 15/243,813.
USPTO; Office Action dated Feb. 24, 2017 in U.S. Appl. No. 15/166,145.
USPTO; Notice of Allowance dated Mar. 7, 2017 in U.S. Appl. No. 14/630,467.
USPTO; Notice of Allowance dated Apr. 26, 2017 in U.S. Appl. No. 15/130,744.
USPTO; Final Office Action dated May 18, 2017 in U.S. Appl. No. 15/243,813.
USPTO; Non-Final Office Action dated Jun. 2, 2017 in U.S. Appl. No. 14/963,475.
USPTO; Requirement for Restriction dated Jun. 5, 2017 in U.S. Appl. No. 14/863,304.
USPTO; Notice of Allowance and Fees Due dated Jul. 11, 2017 in U.S. Appl. No. 15/130,744.
USPTO; Notice of Allowance and Fees Due dated Jul. 31, 2017 in U.S. Appl. No. 15/166,145.
USPTO; Non-Final Office Action dated Aug. 24, 2017 in U.S. Appl. No. 15/253,543.
USPTO; Supplemental Notice of Allowance dated Sep. 13, 2017 in U.S. Appl. No. 15/166,145.
USPTO; Final Office Action dated Sep. 28, 2017 in U.S. Appl. No. 15/243,813.
USPTO; Notice of Allowance dated Oct. 27, 2017 in U.S. Appl. No. 14/955,440.
USPTO; Notice of Allowance dated Nov. 13, 2017 in U.S. Appl. No. 14/955,440.
USPTO; Non-Final Office Action dated Dec. 7, 2017 in U.S. Appl. No. 15/075,769.
USPTO; Non-Final Office Action dated Dec. 18, 2017 in U.S. Appl. No. 15/787,134.
USPTO; Final Office Action dated Jan. 16, 2018 in U.S. Appl. No. 14/963,475.
USPTO; Final Office Action dated Feb. 7, 2018 in U.S. Appl. No. 15/253,543.
USPTO; Non-Final Office Action dated Feb. 8, 2018 in U.S. Appl. No. 14/863,304.
USPTO; Non-Final Office Action dated Feb. 26, 2018 in U.S. Appl. No. 15/804,229.
Webpage print out from http://airgunexpress.com/Accessories/ referencing various level devices.
Webpage print out from http://secure.armorholdings.com/b-square/smarthtml/about.html referencing background on B-Square and their firearm accessories.
Webpage print out from http://secure.armorholdings.com/b-square/tools_scope.html referencing scope and site tools offered by B-Square.
Webpage print out from www.battenfeldtechnologies.com/113088.html referencing a level device.
Webpage print out from www.battenfeldtechnologies.com/wheeler referencing products from Wheeler Engineering.
Webpage print out from www.blackanddecker.com/laserline/lasers.aspx referencing Black & Decker's Auto-Leveling Lasers.
Webpage print out from www.laserlevel.co.uk/newsite.index.asp referencing the laser devices available on the Laserlevel Online Store.
Shooting Illustrated "Update on the .25 SAUM" Jul. 2005 pp. 14-15.
USPTO; Advisory Action dated May 15, 2018 in U.S. Appl. No. 14/963,475.
USPTO; Final Office Action dated Aug. 31, 2018 in U.S. Appl. No. 15/804,229.

(56) References Cited

OTHER PUBLICATIONS

USPTO; Notice of Allowance dated Aug. 31, 2018 in U.S. Appl. No. 15/075,769.
USPTO; Non-Final Office Action dated Sep. 19, 2018 in U.S. Appl. No. 15/243,813.

* cited by examiner

| PART Number: 100709 REV C | | | | | |
|---|---|---|---|---|---|
| Designators | Comment | Footprint | Supplier | Part Number | Description |
| C1 | 4.7uF 0603 | 0603 | Cline | GSM-ECJ-1VB0J475M | CAP 4.7uF 0603 |
| C2 | 0.22uF | 0603 | Cline | GSM-ECJ-1VB1A224K | CAP .22UF X5R 10V 0603 10% LF |
| R2 | 49.9K | 0603 | Cline | GSM-CRCW06034992F | RES 49.9K 0603 1% LF |
| R3 | 20K | 0603 | Cline | GSM-CRCW06032002F | RES 20K 0603 1% LF |
| R1 | 20K (NOTE 1) | 0603 | Cline | GSM-CRCW06032002F | RES 20K 0603 1% LF |
| R1 | 10K (NOTE 1) | 0603 | Cline | GSM-CRCW06031002F | RES 10K 0603 1% MTL LF |
| Q1 | DMG1013T-7 | SOT-523 | Cline | GSM-DMG1013T-7 | MOSFET P-CH SOT-523 |
| M1 | EM4013SMT-45BC10&33-G | EM4015SMT | Cline | GSM-LT-MICROPHONE000 | TSS-4012EC1033Y3-GP |
| S1 | TL3315NF250Q | TL3315 | DIGIKEY | TL3315NF250Q | SWITCH, DOME |
| S3 | TL3315NF250Q | TL3315 | DIGIKEY | TL3315NF250Q | SWITCH, DOME |
| S4 | TL3315NF250Q | TL3315 | DIGIKEY | TL3315NF250Q | SWITCH, DOME |
| U1 | PIC12F1571-E/MS(8) | MSOP8 | Cline | GSM-LT1911SWITCH | PIC12F1571 MSOP8 LT1911v10.HEX |
| PWB | 2.222"x2.715"x.062" | 2 Layer | | 100708-01 rev C | Printed Wiring Board FR4 1 oz copper Gold Plate Black Solder Mask with White Silk Screen |
| | | | | | |
| Notes: | | | | | |
| 1. Select R1 based on M1 number of holes in the microphone. | | | | | |
| 3 or 6 holes use 10K ohm | | | | | |
| 5 holes use 20K | | | | | |
| 2. Do not populate S2 | | | | | |
| | | | | | |
| Theory of Operation:the master module. | | | | | |
| With a single push of S4 it will turn on the trainer mode, with 2 laser pulses. After 5 mins. in unused trainer mode it returns to sight mode. | | | | | |
| With another push of button it returns to sight mode, with a 1 laser pulse. | | | | | |

FIG.7

LIGHT SIGHTING AND TRAINING DEVICE

CROSS REFERENCE TO RELATED APPLICATIONS

Each of the following applications are incorporated herein by reference: U.S. application Ser. No. 14/963,475 filed on Dec. 9, 2015, now U.S. Patent Application Publication No. 2016-0161220 entitled "Master Module Light Source and Trainer"; U.S. application Ser. No. 14/459,274 filed on Aug. 13, 2014, now U.S. Pat. No. 9,297,614 entitled "Master Module Light Source, Retainer and Kits"; U.S. application Ser. No. 15/804,229 filed on Nov. 6, 2017 and entitled "Boresighter Trainer for Gun."

BACKGROUND OF THE INVENTION

There are laser sights used with a gun when firing bullets, and laser trainers, used with a gun when, instead of firing a bullet when the firing pin is activated, a laser light beam is generated. Light (particularly laser) sighters and laser trainers for guns have in the past been different products, requiring the owner of a firearm to purchase at least two separate products.

SUMMARY OF THE INVENTION

The present invention is a single device configured to be part of a grip for a pistol handle. The pistol handle may be utilized with any type of suitable weapon, such as a real gun or toy gun (including BB guns and paint-ball guns). The grip may be used with any suitable style of gun, such as an automatic pistol, revolver, machine pistol, or assault-style rifle that incorporates a light source (preferably a laser), a power source (such as one or more batteries), and a control unit (which has one or more switches) that controls the operation of the light source.

The sighter/trainer has at least two modes that are selected by a user operating a first switch to select between the modes. In a first mode, the light source is on constantly when a user activates a second switch, so a user can sight a target with a light (preferably laser light) emitted by the sighter/trainer. In a second mode, the sighter/trainer emits laser light for a short duration when it is activated by a sound, such as the sound of the firearm firing pin striking. The sighter/trainer may also have a third mode in which it is turned off. The sighter/trainer is not limited to any particular structure, although the preferred structure is as described herein.

Utilizing the sighter/trainer, the owner of a firearm need purchase only one product to: (1) sight a target; and (2) train using light instead of live ammunition. Dealers could reduce their inventory of products because only a single product is required for firearm sighting and firearm training. Moreover, the sighter/trainer is configured so a single product attached to the pistol grip of a gun is suitable for use both by right-handed and left-handed people, which further reduces the number of products and inventory.

A sighter/trainer according to the invention could be (1) sold separately as an individual product, (2) sold assembled on a gun, (3) sold as a kit with multiple sighter/trainer units, each of which could fit a different style or size of pistol handle, or (4) sold as a kit with the sighter/trainer and a gun with a pistol handle on which the sighter/trainer fits.

BRIEF DESCRIPTION OF THE DRAWINGS

FIG. 7 is a list of exemplary components referenced in FIG. 6.

DETAILED DESCRIPTION OF PREFERRED EMBODIMENTS

Figure 1:
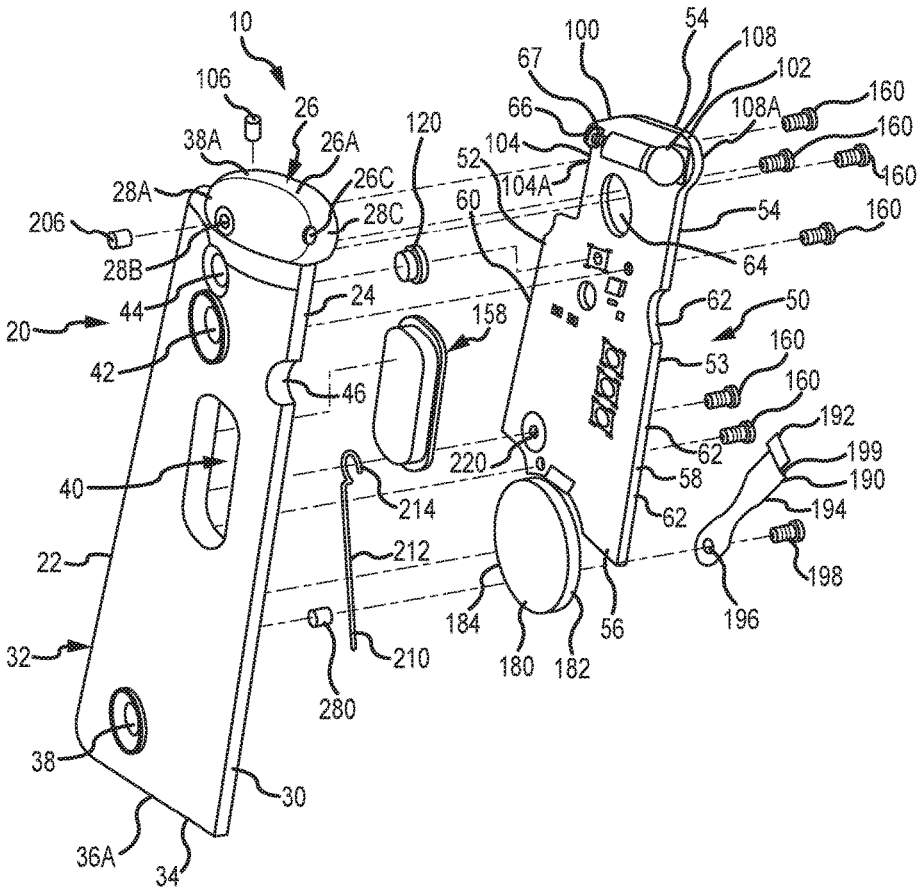
FIG. 1 is an exploded view of a sighter/trainer in accordance with aspects of the invention.

Turning now to the drawings where the purpose is to describe preferred embodiments of the invention and not to limit same, FIG. 1 is an exploded view of a sighter/trainer 10 according to aspects of the invention. Sighter/trainer 10 has a panel 20, a circuit board 50, and a laser module 100. Sighter/trainer 10 is configured to fit on a pistol handle of a gun as one-half of the grip on the handle. Sighter/trainer 10 may be for any suitable real gun or toy gun, such as a semi-automatic pistol that uses a magazine of bullets, a revolver, a machine pistol, or a rifle (such as an assault-style rifle), which includes a pistol handle. The sighter/trainer 10 may be configured to fit pistol handles of essentially any shape or size.

Panel 20 as shown is configured to be on the right-hand side of the pistol handle (viewed in the direction of fire of the pistol), and it thus forms one side of the grip for the pistol handle. Alternatively, the panel 20 and sighter/trainer 10 could be configured for panel 20 to be on the left-hand side of the pistol handle. This configuration is not shown in the drawings but would be understood by one skilled in the art based on this disclosure.

Panel 20 has an outer surface 22, at least part of which is preferably textured to provide a better grip by a human hand. Panel 20 also has an inner surface 24 that forms a cavity 49 to house various components, as explained below. Panel 20 further includes a top portion 26 with opening 28A formed in top surface 26A, opening 28B formed in side surface 26B, opening 28C in front surface 26C, front edge 30, rear edge 32, bottom 34, and opening 36 through which a battery can be inserted or removed.

Openings 38 and 44 are for receiving fasteners and securing panel 20 to the pistol handle. There is also an indentation 46 for a better fit for this embodiment on the pistol handle and/or to accommodate other fasteners or components of the pistol handle. Opening 40 and button 150 are positioned such that a right-handed shooter can press button 150 with the palm side of the fingers when holding the gun handle, and a left-handed shooter can press button 150 with the fingers of the left hand (which wrap around front edge 30) when holding the pistol handle. A grip configured to be on the left-hand side of a pistol handle would function in a mirror-image manner.

At least one circuit board 50 is configured to be received in cavity 49 formed by side 24 of panel 20. In the embodiment shown, there is a single circuit board 50, but a circuit board according to this disclosure could include multiple sections (i.e., multiple circuit boards) that are electrically connected. For example, there could be two or three separate circuit boards that provide the functionality of the at least one circuit board 50. Circuit board 50 has a first side 52, a second side 53, a top edge 54, a bottom edge 56, a front edge 58, a back edge 60, three compression switches 62 disposed on first side 52, opening 64, bracket 66, compression switch 68, and openings 70 to receive fasteners 160, which pass through openings 70 and are received in screw bosses 51 on second side 24 of panel 20 in order to secure circuit board 50 to panel 20. A negative power connector 220 with opening 222 is in circuit board 50 and receives a fastener 160 through opening 222 which fastens to a screw boss 51. Fastener 160 preferably touches or is connected to circuit board 50 and transfers current to circuit board 50.

Button 150 and switches 62 are positioned for ease of use both by right-handed and left-handed persons. Button 150 is preferably between ¾" and 1¼" in length (at its greatest length, which is measured across dimples 150A) and could have a length at its greatest length of ½", ⅝", ¾", ⅞", 1", 1⅛", 1¼", 1⅜", 1½", 1⅝", 1¾", 1⅞", 2", or any length between ½" and 2". The width of switch 62 at its widest point (as measured across any of dimples 150A) is about ½" to ⅝", but could have a width of ⅜", ½", ⅝", ¾", ⅞", 1", 1⅛", or any width between ⅜" and 1⅛". The distance from top 26A to top edge 150B of button 150 is about 25%-35% of the distance from top 26A to bottom 34 measured in a straight line, but could be about 20%, 25%, 30%, 35%, 40% or any percentage between 20% and 40%. The distance from side 30 the center of button 150 as measured in a straight line is about 20%-30% of the distance from side 30 to side 32 as measured in a straight line through the center of button 150, but the distance could be 15%, 20%, 25%, 30%, 35%, 40%, or any percentage between 15% and 40%. Button 150 preferably has one or more dimples 150A on its inside surface, wherein each dimple is configured to align with a switch 62 when sighter/trainer 10 is assembled. When the outer side of button 150 is pressed by a user, one or more of dimples 150A depresses one or more switches 62 to activate light source 100 when sighter/trainer 10 is in a first operational mode.

Figure 3:
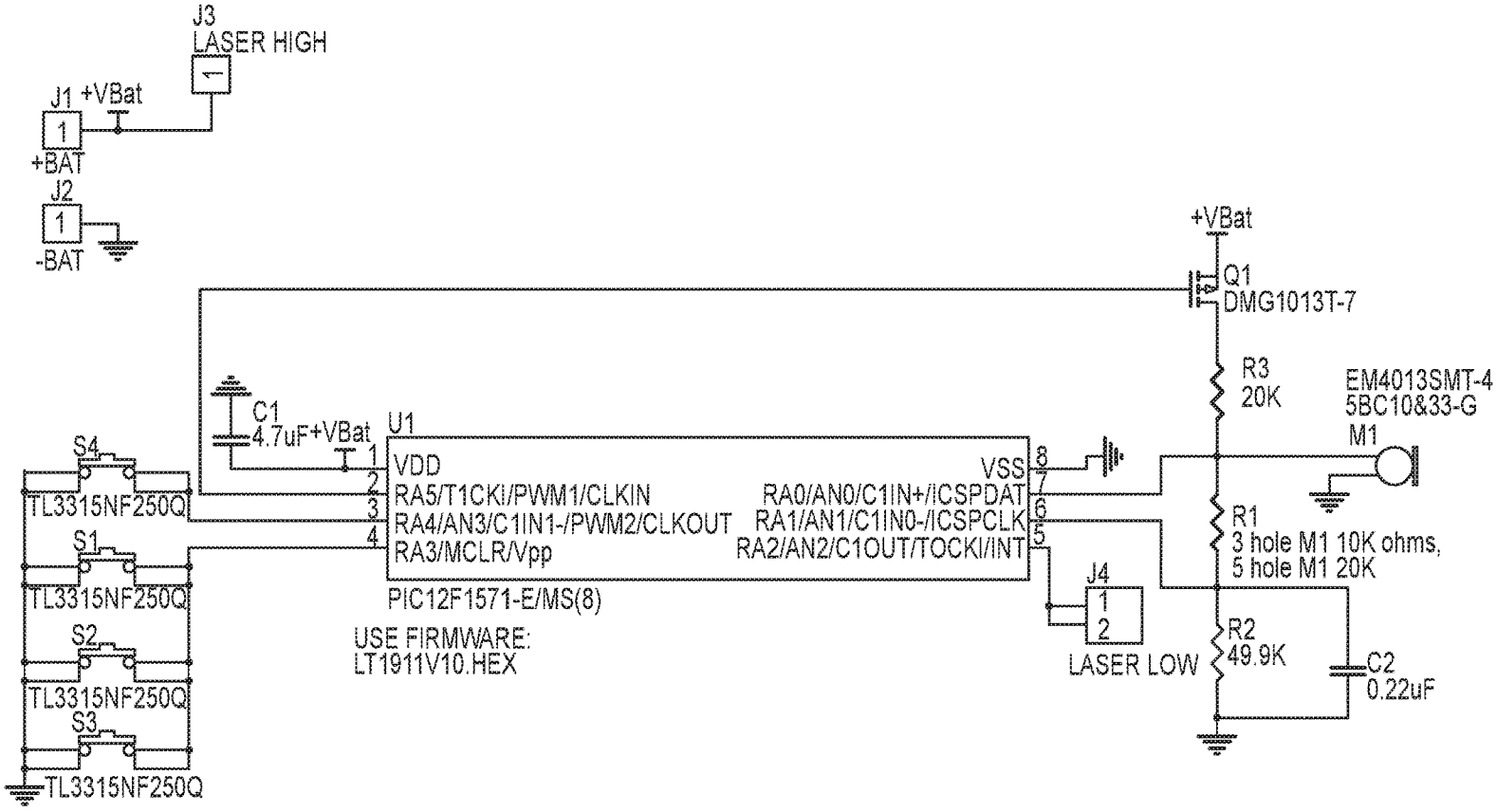
FIG. 3 illustrates exemplary circuitry for the circuit board of FIGS. 1B and 2.
Figure 4:
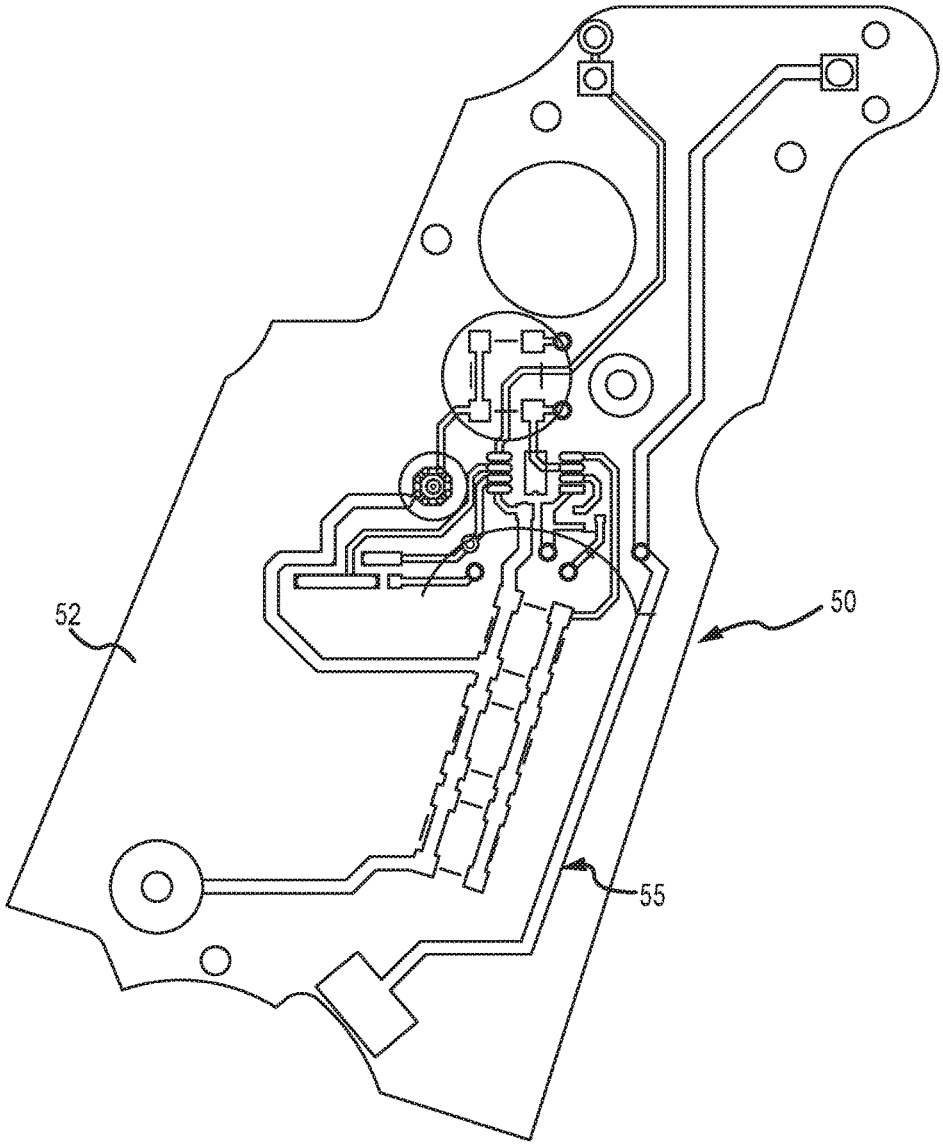
FIG. 4 illustrates exemplary circuitry for the circuit of FIGS. 1B and 2.
Figure 5:
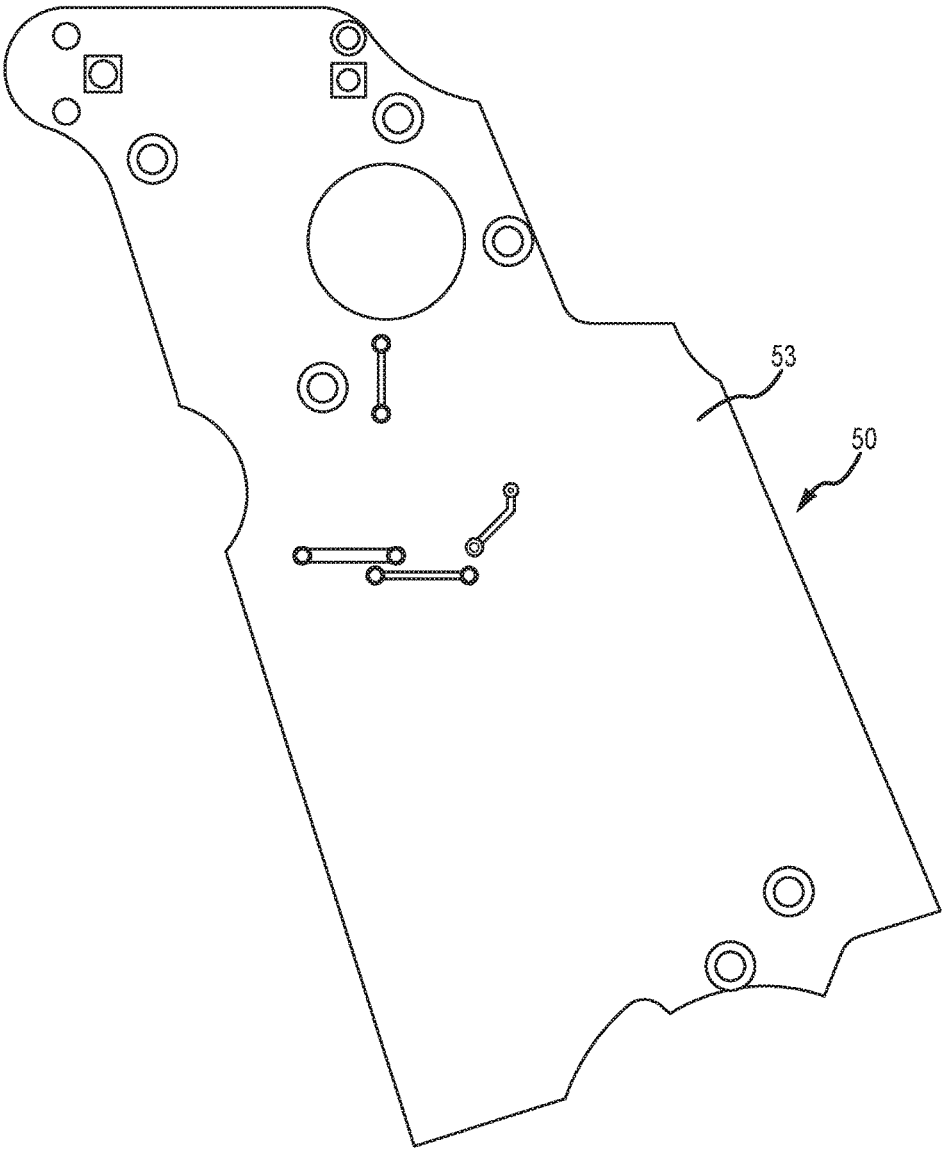
FIG. 5 illustrates exemplary circuitry for the circuit of FIGS. 1B and 2.
Figure 6:
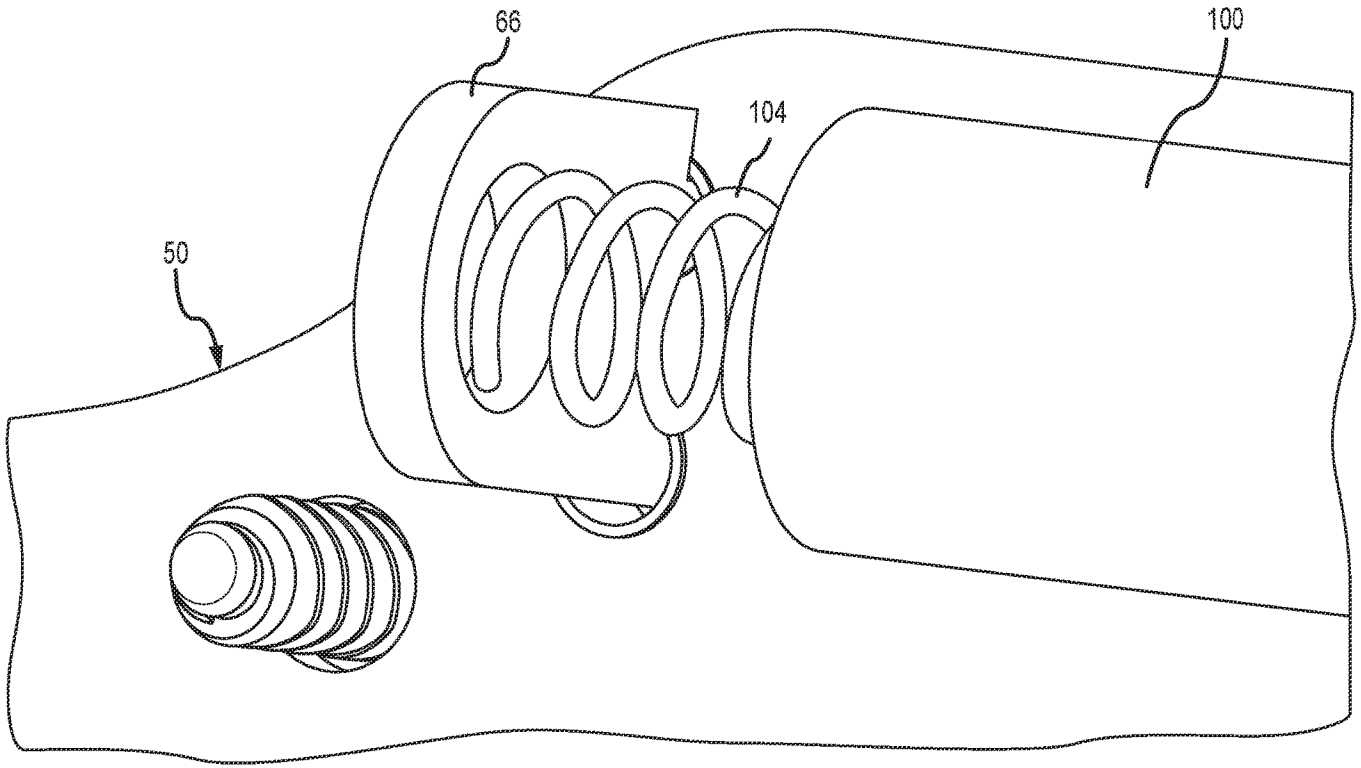
FIG. 6 is a close-up, partial side, perspective view of a laser module and printed circuit board according to the aspects of the disclosure.

Electrical circuitry 55 (examples of which are shown in FIGS. 3-5) is contained in, disposed on, and/or coupled to circuit board 50, for example on first side 52 of circuit board 50 and optionally in part on second side 53. For example, circuit board 50 may be coupled to and/or electrically interconnect various resistors, capacitors, diodes, inductors, microprocessors, microcontrollers, transistors, integrated circuits, and/or the like in order to implement desired functionality for sighter/trainer 10. FIGS. 40 and 41 of U.S. Application Publication 2016-0161220 entitled "Master Module Light Source and Trainer" also show an exemplary circuit diagram and corresponding part listing for an exemplary sighter/trainer 10.

Switch 68 rests against and can be depressed by button 170, which can be accessed through opening 42 when sighter/trainer 10 is assembled, to change the operational mode of sighter/trainer 10, for example to be either in a first operational mode as a laser sighter or in a second operational mode as a laser trainer. Switches 62 on side 52 of circuit board 50 are positioned against and can be depressed by button grip 150 to contact the circuitry on side 52 and transfer power from battery 180 when sighter/trainer 10 is in its first operational mode, as discussed below.

Figure 1A:
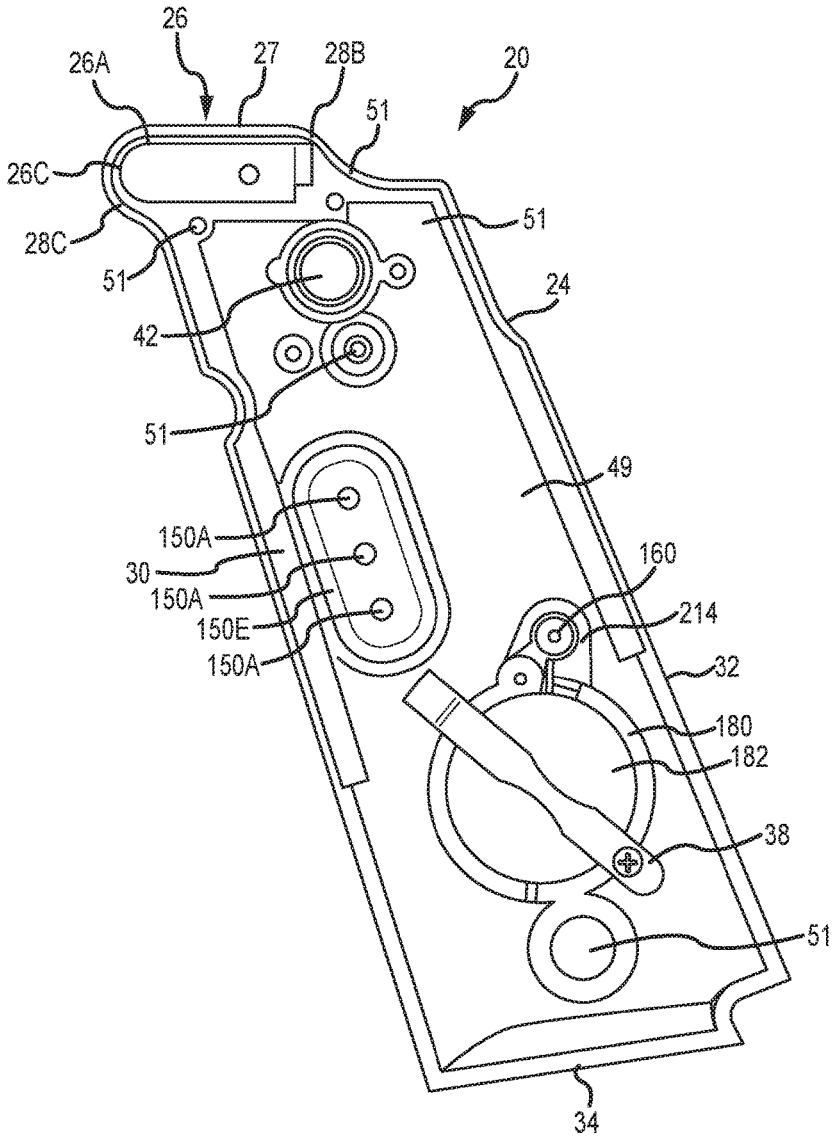
FIG. 1A is side view of a panel of FIG. 1.
Figure 1B:
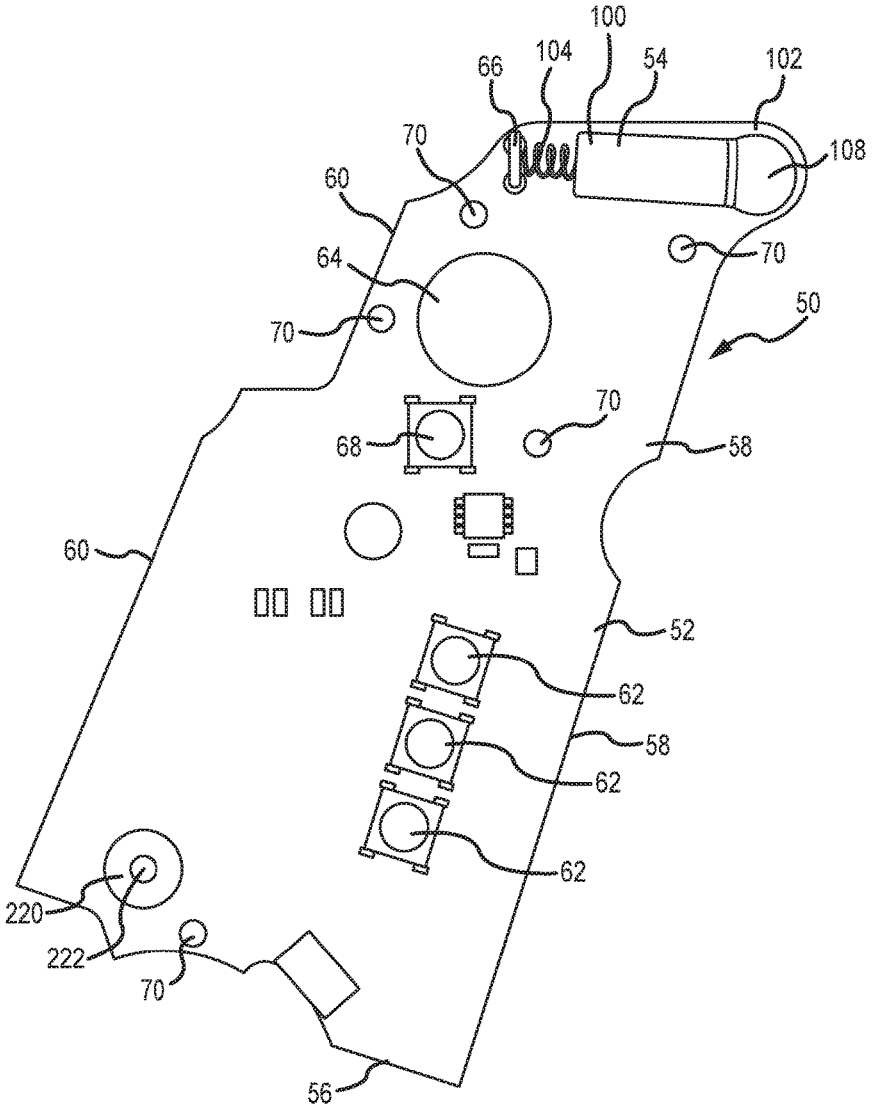
FIG. 1B is a side view of the circuit board of the sighter/trainer of FIG. 1.
Figure 2:
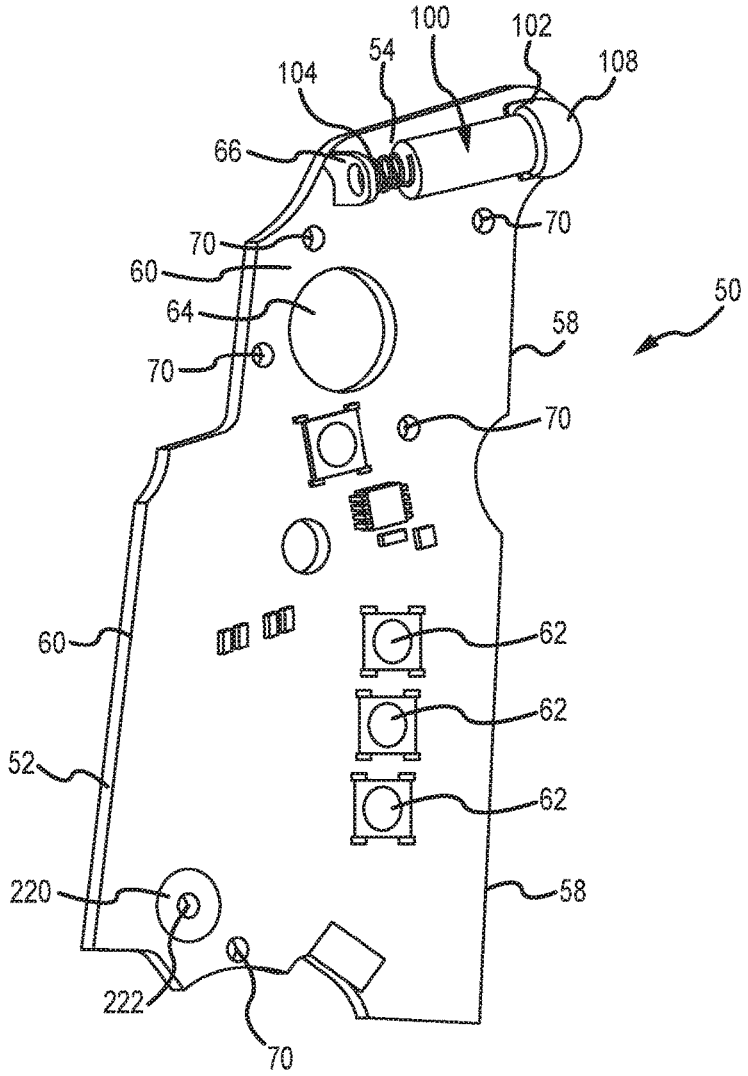
FIG. 2 is a perspective, side view of the sighter/trainer of FIG. 1.

Battery 180 is preferably a coin cell battery, for example a CR2032 battery, and is received as shown in FIG. 1A. Battery 180 could be any suitable type of battery and is most preferably a lithium 6V coin cell battery, but could have a voltage between 3V and 6V. Battery 180 has a first (positive) terminal on side 182, second (negative) terminal on side 184, and can be inserted and removed from sighter/trainer 10 by removing panel 20 and then removing and/or inserting another battery 180. Light module 100, which as shown is a laser module that projects red laser light (although any suitable laser may be used), fits against laser ball seat tab 102, and has a first end 108 with an opening 108A through which light is emitted, and a spring 104 extending from its second end 104A. Spring 104 is received in opening 67, which is conductive and preferably plated, to provide a conductive path through the circuitry to light module 100.

Positive battery contact 190 has a flange 192, a first side 194, and an aperture 196. Fastener 198 passes through opening 196, through insulating thread insert 200, and is received in a boss in cavity 49 of panel 20. Negative battery contact 210 is electrically conductive, has a stem 212 and a partial loop 214. When sighter/trainer 10 is assembled, a fastener 160 passes through opening 222 and through partial loop 214, and is secured in a boss 51 on panel 20. In this manner, when sighter/trainer 10 is assembled, the second (negative) side 184 of battery 180 touches stem 212 of positive battery contact 210 and partial loop 214 is positioned against positive energy transfer structure 220 to provide a conductive path through screw 160 and facilitate flow of electrical current to circuit board 50.

Similarly, when sighter/trainer 10 is assembled, surface 194 of positive battery contact 190 is positioned against first (positive) side 182 of battery 180 and back surface 199 is positioned against circuit board 50 to provide a conductive path and complete the circuit, thus providing electrical power to circuit board 50 and components electrically connected thereto.

When sighter/trainer 10 is assembled, light module 100 is retained in pocket 27 of upper section 26 of panel 20. A set screw 106 is positioned in opening 28A and can be tightened or loosened to move the first end 108 of light module 100 up and down. Another set screw 106 is positioned in opening 28B and can be tightened or loosened to move first end 108 of light module 100 side to side.

In accordance with aspects of the invention, sighter/trainer 10 is configured to have multiple operational modes. Button 170 can be depressed through opening 44 so that it compresses switch 68, which causes sighter/trainer 10 to be in the first operational mode. When in the first operational mode, laser module 100 is continuously activated when a user presses button grip 150 sufficiently to depress one or more of switches 62, which causes electrical current to flow from battery 180 to light source 100 and cause light source 100 to emit a beam of light. In this manner, sighter/trainer 10 may emit a continuous laser beam for targeting (or sighting) purposes. In this mode, when a switch 62 is not depressed, no electrical current (and/or only minimal electrical current) flows to light source 100 and light source 100 is off.

Button 170 can also be pressed to depress switch 68 and cause sighter/trainer 10 to be in a second operational mode. In the second operational mode, light module 100 is activated for a limited-duration pulse responsive to detection of a particular acoustic signature received at microphone 702 (for example, as seen in FIGS. 36 and 39 of U.S. Patent Application Publication No. 2016-0161220). In this manner, sighter/trainer 10 may be utilized to emit a pulse from laser module 100 only after detection of a sound, such as the sound of operation of a firing pin.

Button 170 of sighter/trainer 10 may be pressed to depress switch 68 to change the operational mode of sighter/trainer 10 back and forth from the first operational mode to the second operational mode, depending on what the user desires. Sighter/trainer 10 may also have a third operational mode in which sighter/trainer 10 is off and electrical current does not flow to light source 100 even if one or more switches 62 are depressed. In that case, the user can press switch 170 to go from, for example, the first operational mode, then to the second operational mode, to the third operational mode, and then back to the first operational mode.

Sighter/trainer 10 may utilize a microprocessor 700 configured to control operation of sighter/trainer 10, for example a PIC12F1571 microprocessor offered by Micro-Chip Corporation (Chandler, Ariz.). However, any suitable microprocessor 700 may be used. Microprocessor 700 is responsible for governing operation of sighter/trainer 10, including activation and deactivation of light source 100, changing sighter/trainer 10 from a first operational mode to a second operational mode responsive to switch or button inputs, and so forth. Microprocessor 700 may accommodate the control inputs from microphone 702 as well as switch (es) 68, as well as other control inputs and signal outputs utilized in sighter/trainer 10. Microprocessor 700, microphone 702, light source 100, and other components of sighter/trainer 10 may be mechanically and electrically coupled to one another via circuit board 50 and the traces thereon and/or therein, for example as illustrated in FIGS. 3-5 herein (and/or in FIGS. 37, 38, 40, 41, 43, and 44 of U.S. Patent Application Publication No. 2016-0161220). Additionally, various connective wires may be utilized, as needed, in order to provide desired electrical connections within sighter/trainer 10.

Thus, in accordance with these aspects a single sighter/trainer 10 may be used as a targeting laser using live ammunition, yet also suitable for training without live ammunition. Additionally, sighter/trainer 10 is configured for ambidextrous operation, being suitable for use by both right-handed and left-handed shooters without modification.

Some specific, nonlimiting examples of the invention follow:

1. A sighter/trainer device configured to be attached to the pistol handle of a gun, wherein the grip comprises:
   (a) a panel;
   (b) at least one circuit board configured with circuitry having a first operational mode and a second operational mode;
   (c) a laser in communication with the circuit board;
   (d) a power source in communication with the circuit board; and
   (e) a switch in communication with the circuit board, the switch being moveable to change the operational mode of the circuitry.
2. The sighter/trainer device of example 1 that includes a second button that can be depressed to cause electrical current to be delivered to the laser when the at least one circuit board is in its second operational mode.
3. The sighter/trainer device of example 2, wherein the second button has a length of 1" or more and a width of ½" or more.
4. The sighter/trainer device of example 2, wherein the second button has a height of 1¼" to 3".
5. The sighter/trainer device of example 2, wherein the second button presses against a plurality of switches on the circuit board.
6. The sighter/trainer device of example 2, wherein the second button presses against three switches on the circuit board.
7. The sighter/trainer device of example 2, wherein the panel has a front edge and the second button is positioned no more than ¾" behind the front edge.
8. The sighter/trainer device of example 2, wherein the panel has a bottom and the second button is positioned at least 2" from the bottom.
9. The sighter/trainer device of example 2, wherein the panel has a height and the second button is positioned entirely in the top half of the height.
10. The sighter/trainer device of example 2, wherein the panel has a width and the second button is positioned entirely in the front half of the width.
11. The sighter/trainer device of example 6, wherein the through bolt hole is plated.
12. The sighter/trainer device of example 7 or 8, wherein a spring is retained in the through bolt hole.
13. The sighter/trainer device of example 8, wherein the spring is soldered in the through bolt hole.
14. The sighter/trainer device of example 8 or 9, wherein the spring biases the light source away from the spring.
15. The sighter/trainer device of any of examples 8-10, wherein the spring provides a negative electrical contact for the light source.
16. The sighter/trainer device of example 1, wherein electrical current from the power source travels through the first circuit board to reach the light source.
17. The sighter/trainer device of example 15, wherein electrical current from the power source travels through the first circuit board and second circuit board to reach the light source.
18. The sighter/trainer device of any of examples 1-16, wherein the light source is a laser.
19. The sighter/trainer device of any of examples 1-18, wherein the power source is in a grip that is connected to the first circuit board.
20. The sighter/trainer device of any of examples 1-19, wherein the power source is one or more batteries.
21. The sighter/trainer device of example 20, wherein each adjustment device is a set screw.
22. The sighter/trainer device of example 20 or 21, wherein one of the adjustment devices moves the light source from side to side and the other adjustment device moves the light source up and down.
23. The sighter/trainer device of any of examples 1-22 that is configured to cause the light source to operate in any of the following modes: stay constantly on, stay constantly off, or turn from the on position to the off position after a predetermined period of time.
24. The sighter/trainer device of any of examples 1-24 that includes one or more switches to change the mode of operation of the light source.
25. The sighter/trainer device of example 25, wherein the one or more switches is on the first circuit board.
26. The sighter/trainer device of any of examples 1-25, wherein the power source is one battery.
27. The sighter/trainer device of any of examples 1-26, wherein the power source is enclosed in a panel cavity.
28. The sighter/trainer device of any of examples 1-27, wherein the power source is surrounded by an insulating sleeve.
29. The sighter/trainer device of any of examples 1-28, wherein the grip includes a cap on its end for removing and replacing the power source.
30. The sighter/trainer device of any of examples 1-29, wherein the light source has a first end through which light is emitted and the first end is retained partially in a module cushion ball.

Having thus described preferred embodiments of the invention, other variations and embodiments that do not depart from the spirit of the invention will become apparent to those skilled in the art. The scope of the present invention is thus not limited to any particular embodiment, but is instead set forth in the appended claims and the legal equivalents thereof. Unless expressly stated in the written description or claims, the steps of any method recited in the claims may be performed in any order capable of yielding the desired result.

What is claimed is:

1. A sighting/training device configured to attach to a pistol handle of a gun, the device including:

(a) a panel configured to be one side of a grip on the pistol handle;

(b) a power source;

(c) a light source; and (d) a control to transfer electrical current from the power source to the light source, the control having (i) a first operational mode and a second operational mode, (ii) a first switch to select either the first operational mode or the second operational mode, wherein when the light source is in (iii) the first operational mode it emits light when a second switch is activated to direct electrical current from the power source to the light source, and does not emit light when the second switch is not activated, and (iv) the second operational mode it emits light when it detects the sound of a gun firing pin.

2. The sighting/training device of claim 1, wherein the control is at least one circuit board in electrical communication with the light source, the first switch, the second switch, and the power source.

3. The sighting/training device of claim 2, wherein the light source has a first end through which light is emitted and a second end, and the at least one circuit board has a through bolt hole in communication with the second end.

4. The sighting/training device of claim 3, wherein the through bolt hole is plated.

5. The sighting/training device of claim 3, wherein a spring is in contact with the second end of the light source and is retained in the through bolt hole.

6. The sighting/training device of claim 5, wherein the spring biases the light source away from the through bolt hole.

7. The sighting/training device of claim 5, wherein the spring provides a negative contact for the light source.

8. The sighting/training device of claim 1, wherein the light source is a laser.

9. The sighting/training device of claim 1, wherein the power source and light source are each inside of a cavity of the panel.

10. The sighting/training device of claim 1, wherein the power source is at least one battery.

11. The sighting/training device of claim 2, wherein the circuit board includes a capacitor.

12. The sighting/training device of claim 1 that includes a first button that can be pressed to cause the first switch to cause the control to change between the first operational mode and the second operational mode, and a second button that can be depressed to operate one or more second switches that cause electrical current to flow through the at least one circuit board to the light source when the circuit board is in its second operational mode.

13. The sighting/training device of claim 12, wherein the second button has a length of 1" or more and a width of ½" or more.

14. The sighting/training device of claim 12, wherein the second button has a height of 1¼" to 3".

15. The sighting/training device of claim 12, wherein the second button is positioned against a plurality of switches on the circuit board.

16. The sighting/training device of claim 12, wherein the second button is positioned against three switches on the circuit board.

17. The sighting/training device of claim 12, wherein the panel has a front edge and the second button is positioned no more than ¾" behind the front edge.

18. The sighting/training device of claim 12, wherein the panel has a bottom and the second button is positioned at least 2" from the bottom.

19. The sighting/training device of claim 12, wherein the panel has a height with a top half and the second button is positioned entirely in the top half of the height.

20. The sighting/training device of claim 12, wherein the panel has a width with a front half and the second button is positioned entirely in the front half of the width.

21. The sighting/training device of claim 1, wherein the laser is activated for between about 7.5 milliseconds to about 12.5 milliseconds, or for about 0.1 seconds, when the circuit is activated in the second operational mode.

22. The sighting/training of claim 2, wherein the at least one circuit board has circuitry that is a 3V-6V system.

23. A gun having a pistol handle with the sighting/training device of claim 1 attached to it.

24. The gun of claim 23 that is selected from one or more of the group consisting of: an automatic pistol, a revolver, a machine pistol, an assault-style rifle, a BB gun, an airsoft rifle, and a paint-ball gun.

25. A kit including the sighting/training device of claim 1 and a gun with a pistol handle configured to have the sighting/training device attached to it.

* * * * *